US007208294B2

(12) United States Patent
Tanabe

(10) Patent No.: US 7,208,294 B2
(45) Date of Patent: Apr. 24, 2007

(54) DISPLAY DEVICE AND DISPLAY PANEL DRIVING METHOD

(75) Inventor: Takahisa Tanabe, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 595 days.

(21) Appl. No.: 10/798,900

(22) Filed: Mar. 12, 2004

(65) Prior Publication Data

US 2004/0239597 A1 Dec. 2, 2004

(30) Foreign Application Priority Data

Mar. 12, 2003 (JP) ..... 2003-066267

(51) Int. Cl.
*G09G 3/30* (2006.01)
*G09G 5/00* (2006.01)

(52) U.S. Cl. ..... 435/78; 435/76; 435/79; 435/82; 435/204

(58) Field of Classification Search ..... 345/76, 345/78, 79, 82, 204
See application file for complete search history.

(56) References Cited

U.S. PATENT DOCUMENTS 3,753,231 A * 8/1973 Hilsum ..... 345/76

* cited by examiner

*Primary Examiner*—Richard Hjerpe
*Assistant Examiner*—My-Chau T Tran
(74) *Attorney, Agent, or Firm*—Sughrue Mion, PLLC

(57) ABSTRACT

A display device and a display panel driving method, in which a matrix panel includes pixel portions each have a series circuit of a bistable element and a light emitting element, every time one scan line is specified in order in accordance with an input image signal, a driving line corresponding to at least one pixel portion to be driven to emit light on the one scan line is specified in accordance with the input image signal, a first predetermined voltage lower than a turn-off threshold voltage is applied between the one scan line and the specified driving line, and thereafter a second predetermined voltage higher than a turn-on threshold voltage is applied therebetween.

10 Claims, 7 Drawing Sheets

DISPLAY DEVICE AND DISPLAY PANEL DRIVING METHOD

BACKGROUND OF THE INVENTION

1. Field of the Invention

The present invention relates to a display device and a driving method of a matrix display panel.

2. Description of the Related Art

A matrix display panel of an active driving type is used as a display device in such a personal computer and a movable telephone set. The matrix display panel generally includes TFTs (thin film transistors). An switching element used in each of the TFTs is a semiconductor formed with a material such as an amorphous silicon (a-Si) or a low-temperature polycrystalline silicon (LT p-Si).

However, in the display device having the conventional matrix display panel, there is a problem that the structure for connecting between the matrix display panel and driving system for the display panel and the configuration of the driving system are complex, so that the display device becomes high in cost.

SUMMARY OF THE INVENTION

An object of the invention is to provide a display device of an active driving type and a driving method for a matrix display panel of an active driving type which are capable to form with a simple configuration.

A display device according to the present invention comprises: a matrix display panel including a plurality of driving lines, a plurality of scan lines intersecting with the plurality of driving lines, and a plurality of pixel portions which are arranged at the intersecting portions by the plurality of driving lines and the plurality of scan lines and which each include a series circuit of a bistable element and a light emitting element, wherein when a voltage exceeding a turn-on threshold voltage is applied to the series circuit, the bistable element is in an ON state to allow the light emitting element to electrically connect between a driving line and a scan line associated with the series circuit until a voltage lower than a turn-off threshold voltage is applied to the series circuit, and when a voltage lower than the turn-off threshold voltage is applied to the series circuit, the bistable element is in an OFF state to allow the light emitting element to electrically disconnect between the driving line and the scan line associated with the series circuit until a voltage exceeding the turn-on threshold voltage is applied to the series circuit; a controller which specifies in order one scan line of the plurality of scan lines in accordance with scan timing of an input image signal, and specifies a driving line corresponding to at least one pixel portion to be driven to emit light on the one scan line in accordance with the input image signal; and a driver which applies, every time the one scan line is specified, a first predetermined voltage which is lower than the turn-off threshold voltage, between the one scan line and the specified driving line, and thereafter applies a second predetermined voltage which is higher than the turn-on threshold voltage, between the one scan line and the specified driving line.

A display device according to the present invention comprises: a matrix display panel including a plurality of driving lines, a plurality of scan lines intersecting with the plurality of driving lines, and a plurality of pixel portions which are arranged at the intersecting portions by the plurality of driving lines and the plurality of scan lines and which each include a series circuit of a bistable element and a light emitting element, wherein when a voltage exceeding a turn-on threshold voltage is applied to the series circuit, the bistable element is in an ON state to allow the light emitting element to electrically connect between a driving line and a scan line associated with the series circuit until a voltage lower than a turn-off threshold voltage is applied to the series circuit, and when a voltage lower than the turn-off threshold voltage is applied to the series circuit, the bistable element is in an OFF state to allow the light emitting element to electrically disconnect between the driving line and the scan line associated with the series circuit until a voltage exceeding the turn-on threshold voltage is applied to the series circuit; a controller which specifies in order one scan line of the plurality of scan lines in accordance with scan timing of an input image signal, and specifies a driving line corresponding to at least one pixel portion to be driven to emit light on the one scan line in accordance with the input image signal; and a driver which applies, every time the one scan line is specified, a first predetermined voltage which is higher than the turn-on threshold voltage, between the one scan line and the specified driving line, and thereafter applies a second predetermined voltage which is lower than the turn-off threshold voltage, between the one scan line and the specified driving line.

A method of driving a matrix display panel according to the present invention, the display panel including a plurality of driving lines, a plurality of scan lines intersecting with the plurality of driving lines, and a plurality of pixel portions which are arranged at the intersecting portions by the plurality of driving lines and the plurality of scan lines and which each include a series circuit of a bistable element and a light emitting element, wherein when a voltage exceeding a turn-on threshold voltage is applied to the series circuit, the bistable element is in an ON state to allow the light emitting element to electrically connect between a driving line and a scan line associated with the series circuit until a voltage lower than a turn-off threshold voltage is applied to the series circuit, and when a voltage lower than the turn-off threshold voltage is applied to the series circuit, the bistable element is in an OFF state to allow the light emitting element to electrically disconnect between the driving line and the scan line associated with the series circuit until a voltage exceeding the turn-on threshold voltage is applied to the series circuit; comprises the steps of: specifying in order one scan line of the plurality of scan lines in accordance with scan timing of an input image signal, and specifying a driving line corresponding to at least one pixel portion to be driven to emit light on the one scan line in accordance with the input image signal; and applying, every time the one scan line is specified, a first predetermined voltage which is lower than the turn-off threshold voltage, between the one scan line and the specified driving line, and thereafter applying a second predetermined voltage which is higher than the turn-on threshold voltage, between the one scan line and the specified driving line.

A method of driving a matrix display panel according to the present invention, the display panel including a plurality of driving lines, a plurality of scan lines intersecting with the plurality of driving lines, and a plurality of pixel portions which are arranged at the intersecting portions by the plurality of driving lines and the plurality of scan lines and which each include a series circuit of a bistable element and a light emitting element, wherein when a voltage exceeding a turn-on threshold voltage is applied to the series circuit, the bistable element is in an ON state to allow the light emitting element to electrically connect between a driving line and a scan line associated with the series circuit until a voltage lower than a turn-off threshold voltage is applied to the series circuit, and when a voltage lower than the turn-off threshold voltage is applied to the series circuit, the bistable element is in an OFF state to allow the light emitting element to electrically disconnect between the driving line and the scan line associated with the series circuit until a voltage exceeding the turn-on threshold voltage is applied to the series circuit; comprises the steps of: specifying in order one scan line of the plurality of scan lines in accordance with scan timing of an input image signal, and specifying a driving line corresponding to at least one pixel portion to be driven to emit light on the one scan line in accordance with the input image signal; and applying, every time the one scan line is specified, a first predetermined voltage which is higher than the turn-on threshold voltage, between the one scan line and the specified driving line, and thereafter applying a second predetermined voltage which is lower than the turn-off threshold voltage, between the one scan line and the specified driving line.

DETAILED DESCRIPTION OF THE INVENTION

Embodiments of the present invention will be explained below in more detail with reference to the accompanying drawings.

Figure 1:
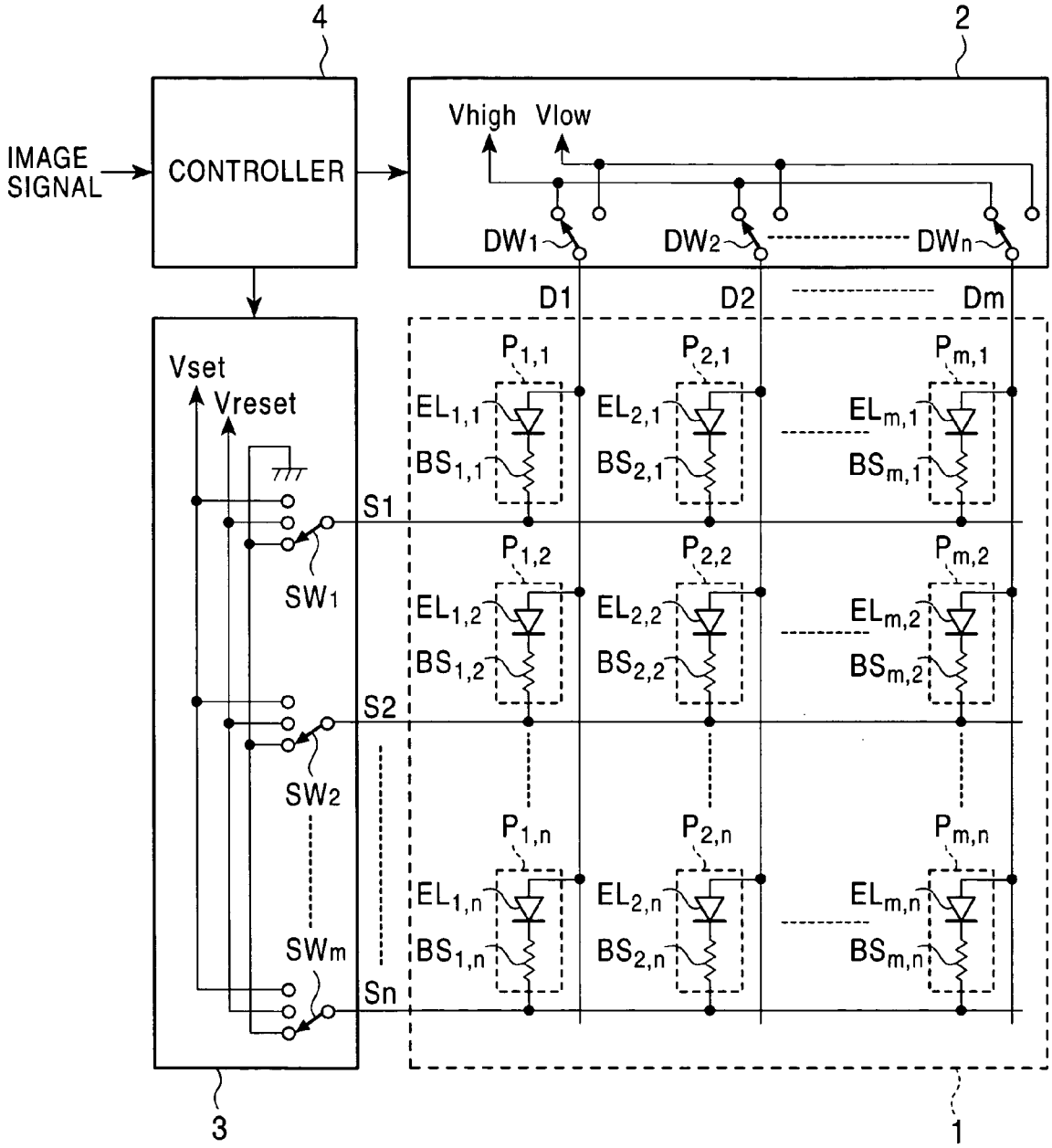
FIG. 1 is a block diagram showing an embodiment of the invention.

FIG. 1 shows a display device according to the invention. The display device comprises a display panel 1, a driving line circuit 2, a scan line circuit 3, and a controller 4. The display panel 1 is a matrix display panel, including a plurality of driving lines D1 to Dm (where m is an integer equal to or greater than 2), a plurality of scan lines S1 to Sn (where n is an integer equal to or greater than 2), and a plurality of pixel portions $P_{1,1}$ to $P_{m,n}$. The driving lines D1 to Dm and the scan lines S1 to Sn are arranged to mutually intersect. The pixel portions $P_{1,1}$ to $P_{m,n}$ are respectively arranged at the positions of intersection of the driving lines D1 to Dm with the scan lines S1 to Sn. The respective pixel portions $P_{1,1}$ to $P_{m,n}$ are series circuits including bistable elements $BS_{1,1}$, to $BS_{m,n}$ and organic EL elements (organic electroluminescence elements) $EL_{1,1}$ to $EL_{m,n}$. Each of the bistable elements $BS_{1,1}$ to $BS_{m,n}$ is a binary memory element with two terminals called OBD (organic bistable memory device). A series circuit of a bistable element and an organic EL element can be represented symbolically as a circuit of a resistance and a diode in series.

Figure 2:
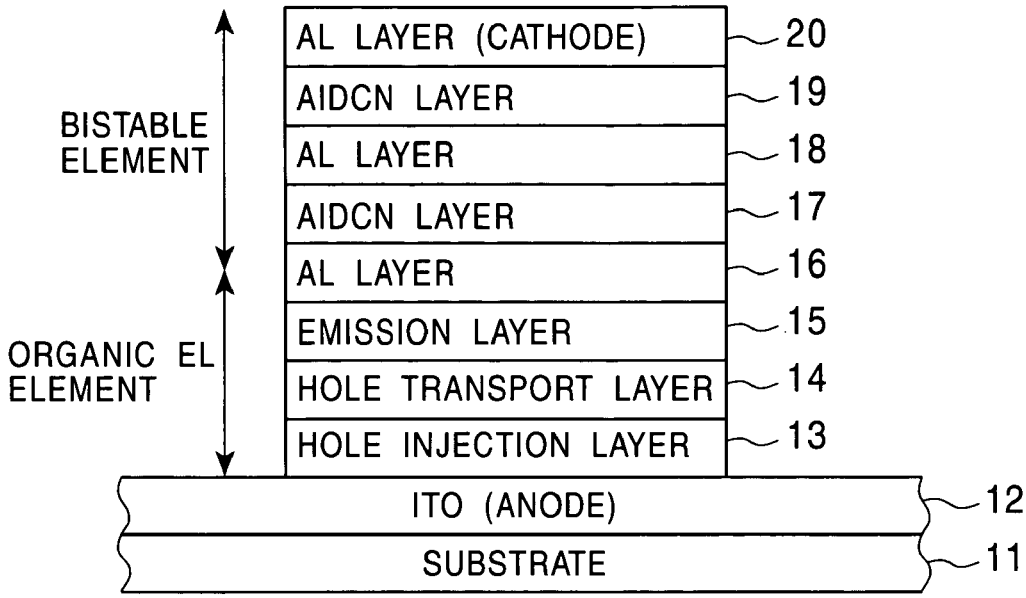
FIG. 2 shows the construction of a composite element in each pixel portion in the device shown in FIG. 1.

The bistable element and organic EL element used in each of the pixel portions $P_{1,1}$ to $P_{m,n}$ are formed integrally as a composite element, as shown in FIG. 2. That is, the composite element is formed by layering, on a substrate 11, an anode 12 made of ITO (indium tin oxide), a hole injection layer 13 made of CuPc (copper phthalocyanine), a hole transport layer 14 made of NPB (N,N'-di(naphthalen-1-yl)-N,N'-diphenyl-benzidine), an emission layer 15 made of Alq3 (tris(8-hydroxyquinoline)-aluminum), an Al (aluminum) layer 16, an AIDCN (2-amino-4,5-imidazole-dicarbonitrile) layer 17, an Al layer 18, an AIDCN layer 19, and an Al layer 20 serving as the cathode. The layered portion from the anode 12 to the Al layer 16 is the organic EL element, and the layered portion from the Al layer 16 to the Al layer 20 is the bistable element. The above structure of the composite element is one example, and another structure or materials having the characteristics of the organic EL element and the bistable element may be used.

Figure 3:
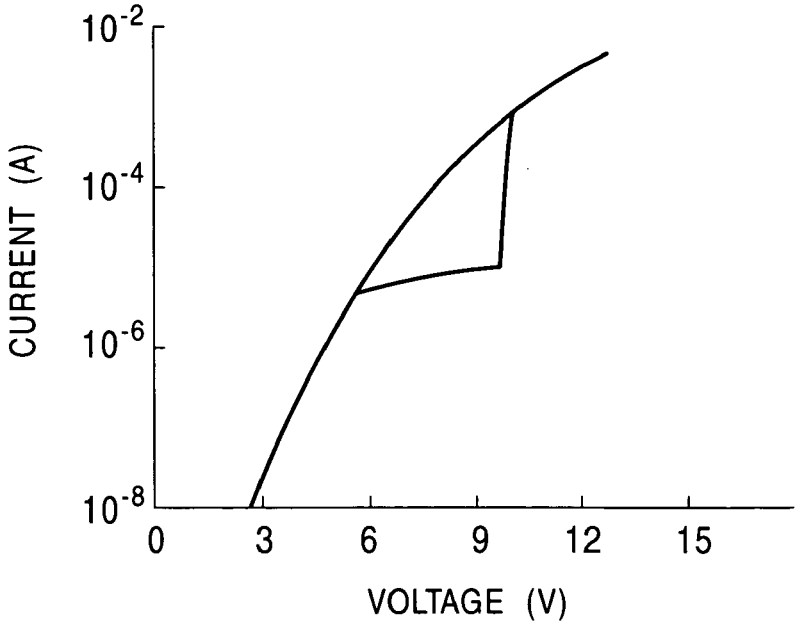
FIG. 3 shows the voltage-current characteristic of the composite element.
Figure 4:
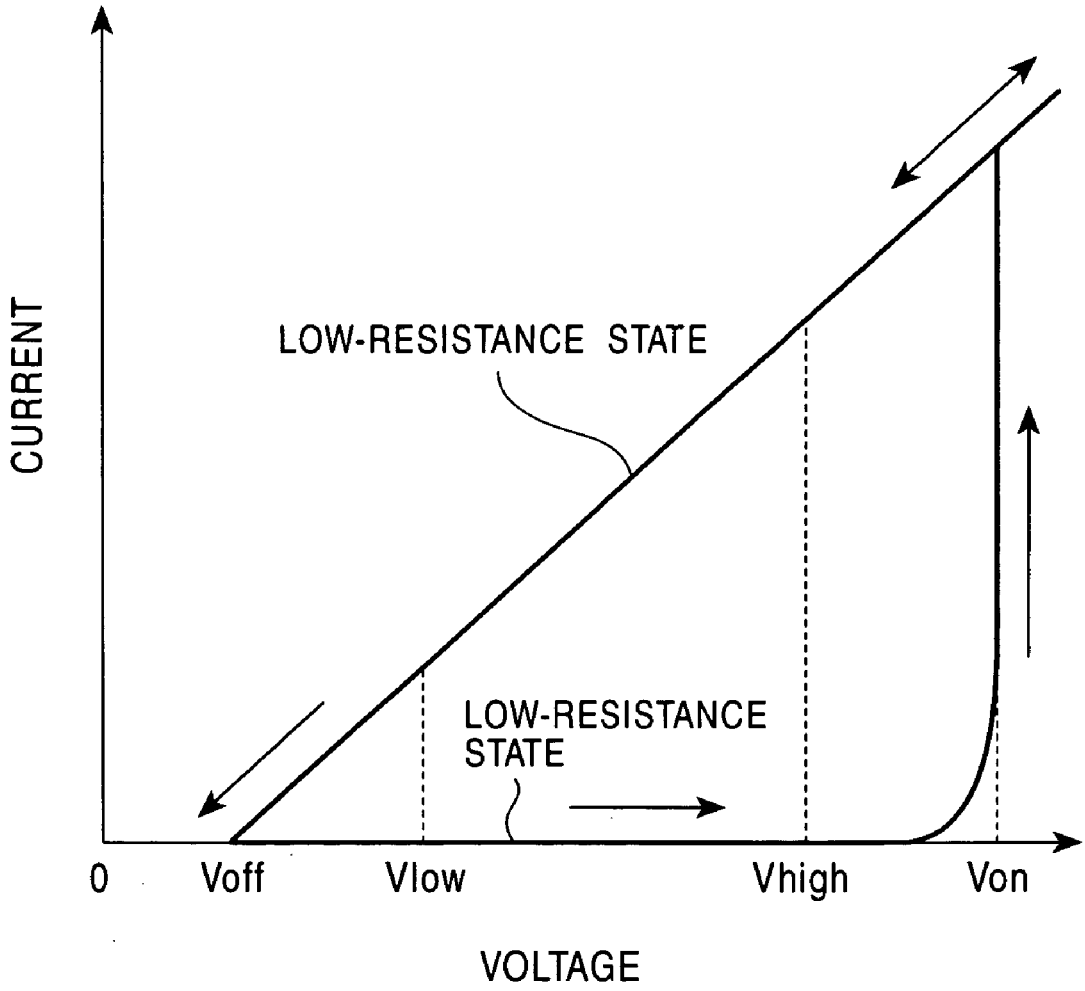
FIG. 4 shows the substantial range from $V_{off}$ to $V_{on}$ of the characteristic shown in FIG. 3, as a linear characteristic.

When a voltage applied between the anode and cathode of the composite element is gradually increased in the forward direction from 0 V, the current flowing between the anode and cathode changes as shown in FIG. 3. The resistance between the anode and cathode is high until that the applied voltage between the anode and cathode from a turn-off threshold voltage Voff (for example, 5 V) to a turn-on threshold voltage Von (for example, 10 V), and the current hardly increases at the voltage range from Voff until just below Von. Upon reaching Von, the resistance between the anode and cathode becomes low. After the resistance has become low, if the applied voltage is decreased, the low resistance is maintained and the current falls. When the applied voltage reaches Voff, the resistance between the anode and cathode becomes high. FIG. 4 shows the substantial range from $V_{off}$ to $V_{on}$ of the characteristic shown in FIG. 3, as a linear characteristic. As is seen from FIG. 3 and FIG. 4, the composite element acts as an organic EL element having a switch. That is, the high-resistance state is the OFF state of the switch, and the low-resistance state is the ON state of the switch. The turn-off threshold voltage Voff is a threshold voltage when the bistable element changes from the on state to the OFF state; the turn-on threshold voltage Von is a threshold voltage when the bistable element changes from the off state to the ON state.

The driving line circuit 2 has a plurality of switches DW1 to DWm corresponding to the plurality of driving lines D1 to Dm. Each of the switches DW1 to DWm selectively supplies either a voltage Vhigh or a voltage Vlow, in accordance with a driving command from the controller 4, to the corresponding driving line D1 to Dm. There is a relationship of Vhigh>Vlow between the voltages Vhigh and Vlow. The voltage Vhigh is, for example, 9 V, and the voltage Vlow is, for example, 7 V.

The scan line circuit 3 has a plurality of switches SW1 to SWn corresponding to the plurality of scan lines S1 to Sn. Each of the switches SW1 to SWn selectively supplies one of voltages Vset, Vreset, 0 V (ground potential), in accordance with a scan command from the controller 4, to the corresponding scan line S1 to Sn. The voltage Vreset is a reset voltage which has a condition of Vreset>0 V. The voltage Vset is a set voltage which has a condition of Vset<0 V. The reset voltage Vreset is, for example, 5 V, and the set voltage Vset is, for example, −2 V.

The controller 4 supplies a scan command for each field to the scan line circuit 3 and a driving command to the driving line circuit 2 in accordance with to the input image signal. The scan command is a command to specify one of the scan lines S1 to Sn in order with predetermined scan timing which is indicated by the input image signal. The driving command is a command indicating light emission or non-light emission of each pixel portion on the one scan line being scanned, in synchronization with the scan timing.

Figure 5:
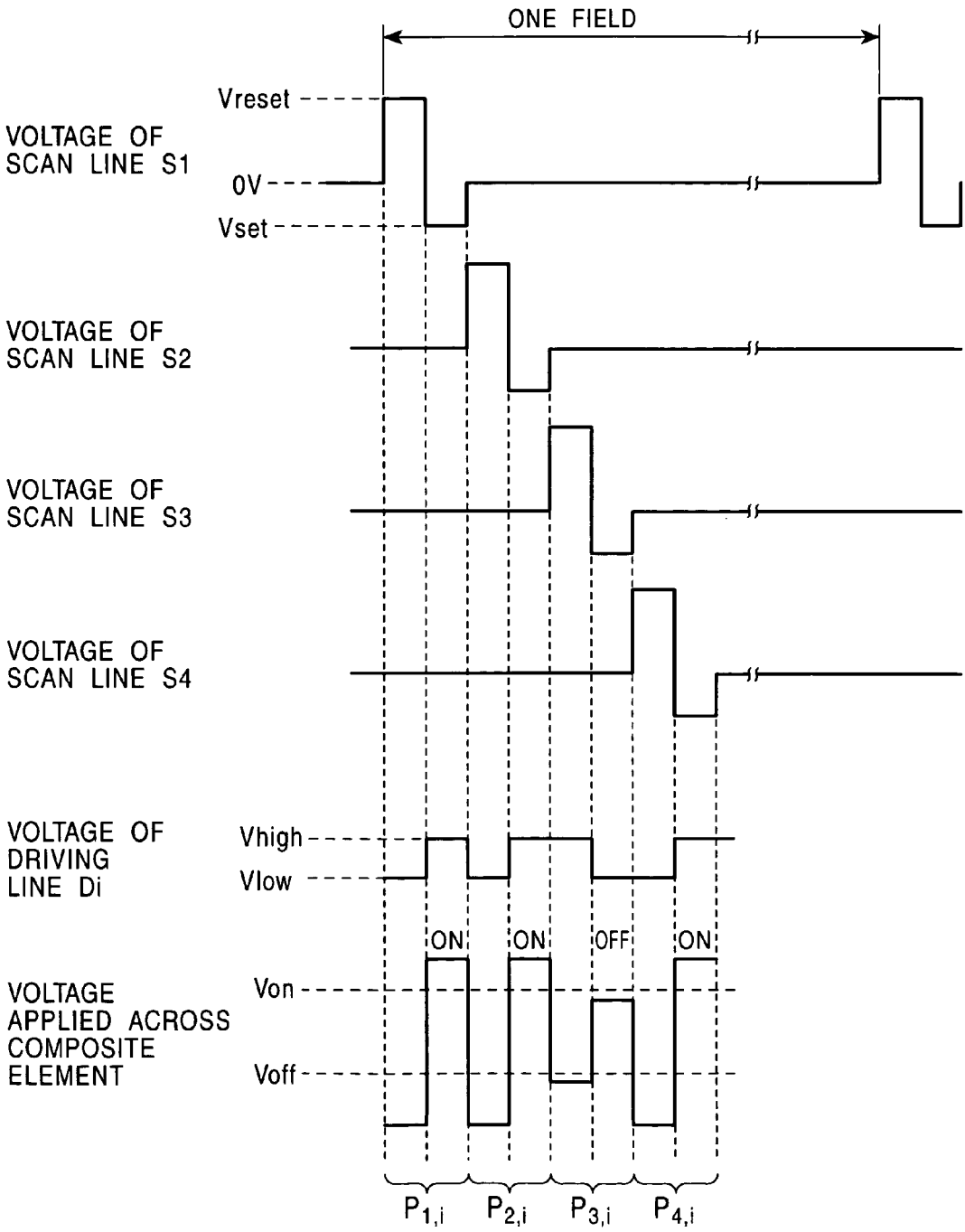
FIG. 5 is a diagram showing waveforms to explain the operation of the device shown in FIG. 1.

In the display device with the above configuration, when an image signal is input, the controller 4 generates the above-described scan command and driving command. In accordance with the scan command, scanning is performed for one field by selectively specifying in order one scan line from the scan line S1 to the scan line Sn, as shown in FIG. 5. If the one scan line specified in the scanning is S1, then the switch SW1 in the scan line circuit 3 switches from a state in which 0 V is selectively output to the one scan line S1, to a state in which the reset voltage Vreset is selectively output to the scan line S1. The voltage Vreset is supplied to the scan line S1 during a reset period. After the reset period, the switch SW1 switches to a state in which the set voltage Vset is selectively output. The voltage Vset is supplied to the scan line S1 for a set period (which may be equal to the length of the reset period). After the set period, the switch SW1 returns to the state of selective output of 0 V to the scan line S1, and the specification as the one scan line for the scan line S1 in one field ends. After the selective switching action is performed for the scan line S1, it is performed for each one scan line from the scan line S2 to the scan line Sn.

During the specification period (which is equal to the combined period of the reset period and the set period) for one scan line, when at least one pixel portion on the one scan line is driven to emit light in accordance with a driving command, the switches DW1 to DWm in the driving line circuit 2 selectively output the voltage Vlow during the reset period, and after the reset period selectively output the voltage Vhigh during the set period, to the driving line (or lines) corresponding to the at least one pixel portion of the driving lines D1 to Dm. On the other hand, since the remaining pixel portions on the one scan line are not driven to emit light, the voltage Vhigh is selectively output to the driving lines corresponding to the remaining pixel portions during the reset period, and after the reset period the voltage Vlow is selectively output during the set period. The voltage Vhigh-Vset is a voltage higher than the turn-on threshold voltage Von of the composite element, and the voltage Vlow-Vreset is a voltage lower than the turn-off threshold voltage Voff of the composite element.

In a pixel portion which is driven to emit light, the voltage Vlow-Vreset, which is lower than the voltage Voff, is applied in the forward direction during the reset period to the composite element having a bistable element and an organic EL element, and the voltage Vhigh-Vset which is higher than the voltage Von, is applied during the set period immediately thereafter. Thus, the bistable element enters the ON state, a driving current flows to the organic EL element via the bistable element, and the organic EL element emits light. On the other hand, in a pixel portion which is not driven to emit light, the voltage Vhigh-Vreset, which is lower than the voltage Voff, is applied in the forward direction during the reset period to the composite element having a bistable element and an organic EL element, and the voltage Vlow-Vset, which is higher than the voltage Voff and lower than the voltage Von, is applied during the set period immediately thereafter. Thus, the bistable element enters the OFF state, a driving current to cause light emission does not flow to the organic EL element, and the organic EL element does not emit light.

When the specification period for one scan line ends in the current one field period, until the specification period for the one scan line in the next one field period, the organic EL elements in the composite elements on the scan line remain in the same state. That is, organic EL elements which emit light in the current one field period continue to emit light until the specification period for the one scan line in the next one field period. On the other hand, organic EL elements which do not emit light continue not to emit light until the specification period for the one scan line in the next one field period. This is because after a scanning specification period, until immediately before the next specification period, either the voltage Vlow or the voltage Vhigh is applied continuously between the anode and cathode of a composite element on the one scan line, so that there is no change in the ON or OFF state of the bistable element.

In the example shown in FIG. 5, the change in voltage on one driving line Di of the driving lines D1 to Dm is shown. First, during the period in which the scan line S1 is specified by scanning, the voltage for light emission, that is, a voltage that changes from the voltage Vlow to the voltage Vhigh, is applied to the driving line Di. The organic EL element $EL_{1,i}$ in the pixel portion $P_{1,i}$ at the position of intersection of the scan line S1 and the driving line Di emits light. Next, during the period in which the scan line S2 is specified by scanning, a voltage is applied to the driving line Di to cause light emission, and the organic EL element $EL_{2,i}$ of the pixel portion $P_{2,i}$ at the position of intersection of scan line S2 and driving line Di emits light. And during the period in which the scan line S3 is specified by scanning, a voltage causing light not to be emitted is applied to the driving line Di; that is, a voltage which changes from the voltage Vhigh to the voltage Vlow is applied, and the organic EL element $EL_{3,i}$ of the pixel portion $P_{3,i}$ positioned at the intersection of the scan line S3 and the driving line Di does not emit light. Then, during the period in which the scan line S4 is specified by scanning, the voltage to cause light emission is applied to the driving line Di, and the organic EL element $EL_{4,i}$ of the pixel portion $P_{4,i}$ positioned at the intersection of the scan line S4 and the driving line Di emits light. Voltages for the scan lines S5 through Sn are not shown, but are similar to the cases of the above S1 through S4.

Figure 6:
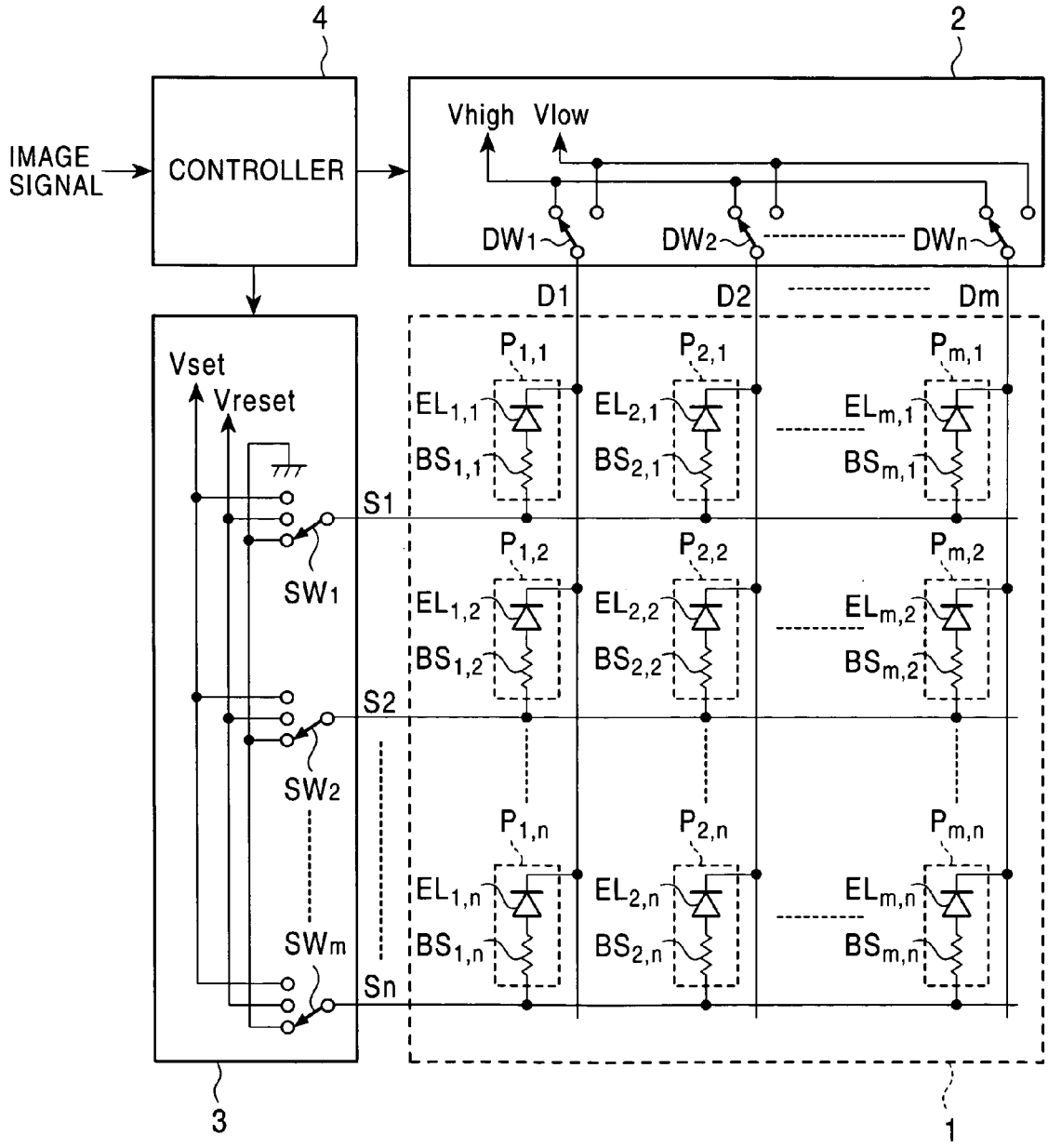
FIG. 6 is a block diagram showing another embodiment of the invention.

FIG. 6 shows another embodiment of the invention. The display device shown in FIG. 6, similarly to the device shown in FIG. 1, comprises a display panel 1, a driving line circuit 2, a scan line circuit 3, and a controller 4.

The anodes and cathodes of the composite elements in the pixel portions $P_{1,1}$ to $P_{m,n}$ of the display panel 1 are connected in a manner opposite that in FIG. 1. That is, as shown in FIG. 6, the cathodes are on the driving-line side, and the anodes are on the scan-line side.

Each of the switches DW1 to DWm in the driving line circuit 2 selectively supplies either the voltage Vhigh or the voltage Vlow, in accordance with a driving command from the controller 4, to the corresponding driving lines D1 to Dm. There is a relationship of Vhigh>Vlow between the voltage Vhigh and the voltage Vlow. The voltage Vhigh is, for example, −7 V, and the voltage Vlow is, for example, −9 V.

The switches SW1 to SWn in the scan line circuit 3 selectively supply a voltage of the voltages Vset, Vreset, and 0 V to the corresponding scan lines S1 to Sn in accordance with a scan command from the controller 4. The voltage Vreset is a reset voltage of Vreset<0 V. The voltage Vset is a set voltage of Vset>0 V. The reset voltage Vreset is for example −5 V, and the set voltage Vset is for example 2 V.

The configuration other than the above portions in display device shown in FIG. 6, is similar to that of the display device of FIG. 1.

Figure 7:
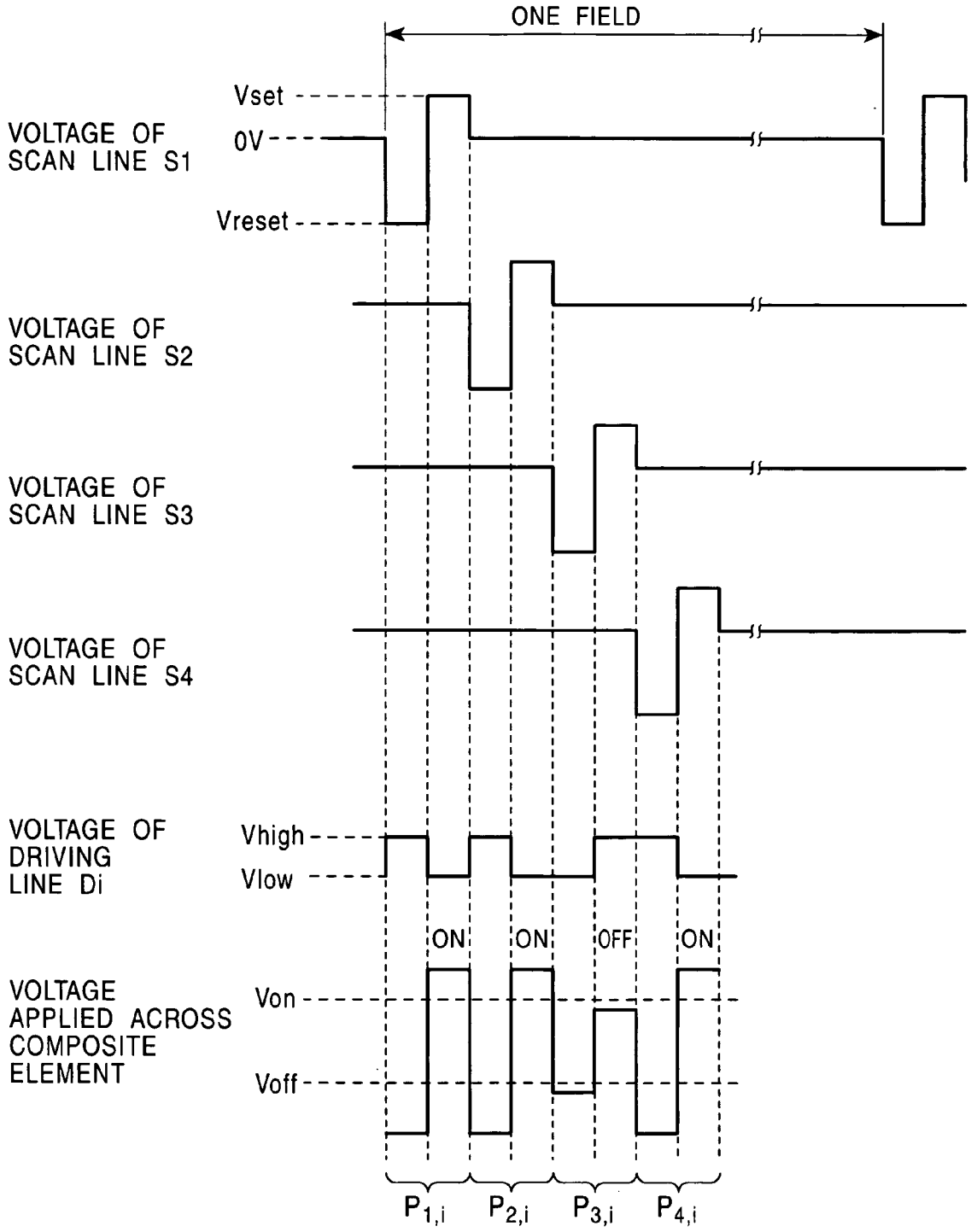
FIG. 7 is a diagram showing waveforms to explain the operation of the device of FIG. 6; and, FIG. 8 is a diagram showing waveforms to explain another operation of the device of FIG. 1.

In the display device with the configuration of FIG. 6, when an image signal is input, the controller 4 generates a scan command and a driving command. In one field, scanning is performed by selectively specifying in order one scan line from the scan line S1 to the scan line Sn in accordance with the scan command, as shown in FIG. 7.

When at least one pixel portion on the one scan line is driven to emit light in accordance with the driving command from the controller 4, the switches DW1 to DWm in the driving line circuit 2 selectively output the voltage Vhigh during the reset period, and after the reset period selectively output the voltage Vlow during the set period, to the driving line (or lines) corresponding to the at least one pixel portion. Since the remaining pixel portions on the one scan line are not driven to emit light, the switches DW1 to DWm selectively output the voltage Vlow to the driving lines corresponding to the remaining pixel portions during the reset period, and after the reset period selectively output the voltage Vhigh during the set period.

In a pixel portion which is driven to emit light, a voltage Vreset-Vhigh, which is lower than the voltage Voff, is applied in the forward direction (anode-cathode) to the composite element having a bistable element and an organic EL element during the reset period, and a voltage Vset-Vlow, which is higher than the voltage Von, is applied in the forward direction during the set period immediately thereafter. Thus, the bistable element enters the ON state, a driving current flows to the organic EL element via the bistable element, and the organic EL element emits light. On the other hand, in a pixel portion which is not driven to emit light, a voltage Vreset-Vlow, which is lower than the voltage Voff, is applied in the forward direction to the composite element having a bistable element and an organic EL element, during the reset period, and a voltage Vset-Vhigh, which is higher than the voltage Voff and lower than the voltage Von, is applied in the forward direction during the set period immediately thereafter. Thus, the bistable element enters the OFF state, a current causing light emission does not flow to the organic EL element, and the organic EL element does not emit light.

When the specification period for one scan line ends in the current one field period, until the specification period for the one scan in the next one field period, the organic EL elements in the composite elements of the scan line remain in the same state.

In the example shown in FIG. 7, the change in voltage on one driving line Di of the driving lines D1 to Dm is shown. First, a voltage to cause light emission, that is, a voltage which changes from the voltage Vhigh to the voltage Vlow, is applied to the driving line Di during the period in which the scan line S1 is specified by scanning, and the organic EL element $EL_{1,i}$ of the pixel portion $P_{1,i}$ positioned at the intersection of the scan line S1 and the driving line Di emits light. Next, the voltage to cause light emission is applied to the driving line Di during the period in which the scan line S2 is specified by scanning, and the organic EL element $EL_{2,i}$ of the pixel portion $P_{2,i}$ positioned at the intersection of the scan line S2 and the driving line Di emits light. In the period during which the scan line S3 is specified by scanning, a voltage to cause light not to be emitted, that is, a voltage which changes from the voltage Vlow to the voltage Vhigh, is applied to the driving line Di, and the organic EL element $EL_{3,i}$ of the pixel portion $P_{3,i}$ positioned at the intersection of the scan line S3 and the driving line Di does not emit light. Then, in the period during which the scan line S4 is specified by scanning, the voltage to cause light emission is applied to the driving line Di, and the organic element $EL_{4,i}$ of the pixel portion $P_{4,i}$ positioned at the intersection of the scan line S4 and the driving line Di emits light. The voltages for the scan line S5 through Sn are not shown, but are similar to the above S1 through S4.

In each of the above embodiments, during the reset period the bistable element of each of the pixel portions on one scan line is forcibly turned off, and during the set period the bistable elements of pixel portions on the one scan line which are driven to emit light are turned on, while the bistable element of each of the remaining pixel portions on the one scan line which are not driven to emit light continues the OFF state. The present invention is not limited thereto, and the bistable elements of each of the pixel portions on the one scan line may be forced on during the reset period, and during the set period the bistable elements of pixel portions which are driven to emit light may be left on, while the bistable elements of the remaining pixel portions which are not driven to emit light are turned off.

Figure 8:
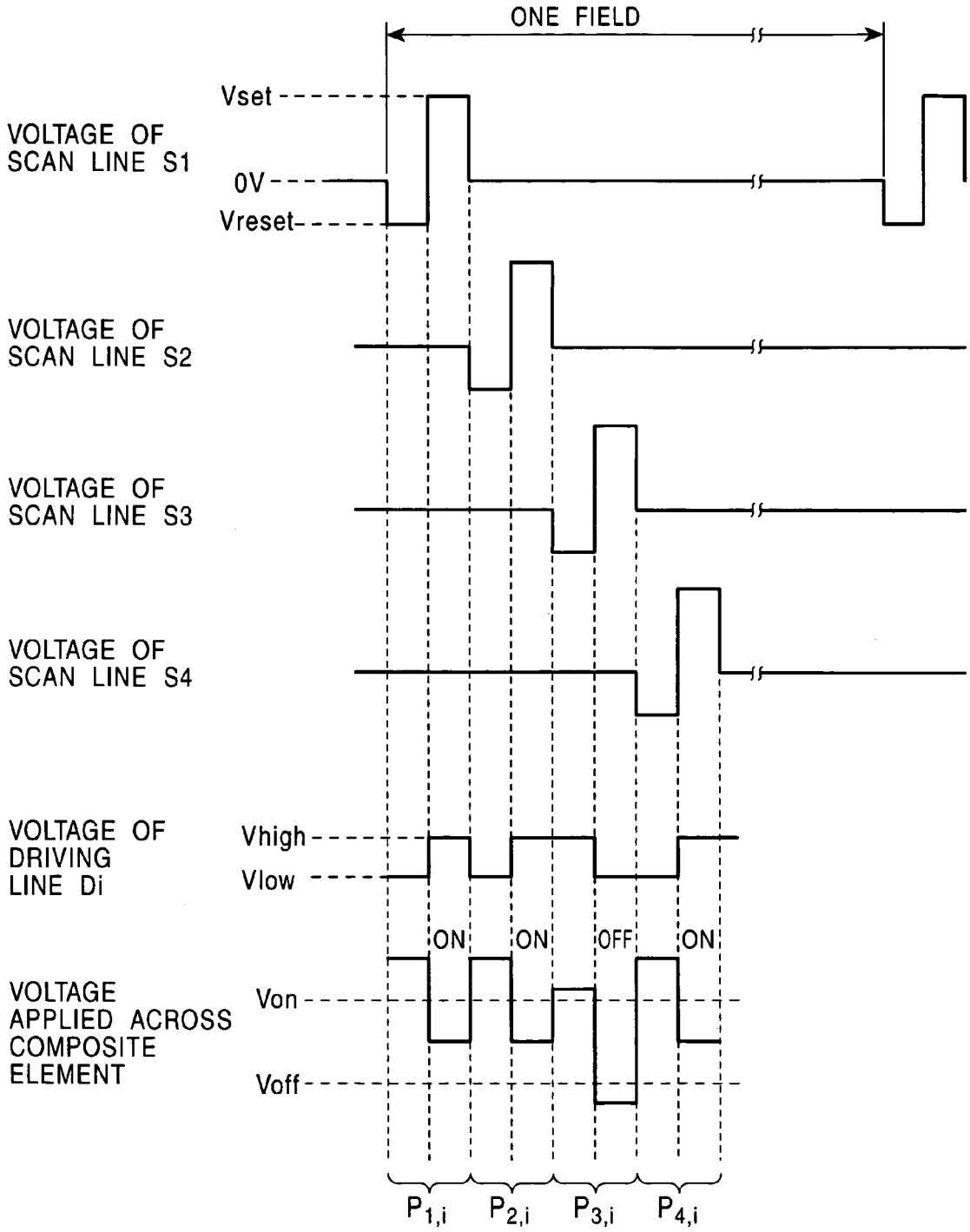

FIG. 8 shows the operation to control the forcible turning-on of the bistable element in each of the pixel portions on one scan line during the above reset period, using the display device shown in FIG. 1. In FIG. 8, the reset voltage Vreset in the device shown in FIG. 1 to which this control operation is applied is lower than 0 V, and the set voltage Vset is higher than 0 V.

In the control operation shown in FIG. 8, in one field period in accordance with a scan command from the controller 4, one scan line is selectively specified in order from scan line S1 to scan line Sn. If the one scan line specified in scanning is S1, then the switch SW1 in the scan line circuit 3 switches from a state of selective output to the scan line S1 of 0 V to a state of selective output to the switch SW1 of the reset voltage Vreset. The voltage Vreset is supplied to the scan line S1 during the reset period. After the reset period, the switch SW1 switches to a state of selective output of the set voltage Vset to the switch SW1. The voltage Vset is supplied to the scan line S1 during the set period (which may be equal to the length of the reset period). After the set period, the switch SW1 returns to the state of selective output of 0 V to the scan line S1, and the specification of the scan line S1 in the one field period ends. After the selective switching operation is performed for the scan line S1, it is performed for each scan line from the scan line S2 to the scan line Sn.

When there is at least one pixel portion to be driven to emit light on the one scan line in accordance with a driving command from the controller 4, the switches DW1 to DWm in the driving line circuit 2 selectively output the voltage Vlow to the driving line (or lines) corresponding to the at least one pixel portion during the reset period, and after the reset period, the voltage Vhigh is selectively output during the set period. On the other hand, since the remaining pixel portions on the one scan line are caused not to emit light, the voltage Vhigh is selectively output to the corresponding driving lines during the reset period, and after the reset period, the voltage Vlow is selectively output during the set period.

In the pixel portion which is driven to emit light, a voltage Vhigh-Vreset, which is higher than the voltage Von, is applied in the forward direction (anode-cathode) during the reset period to the composite element having a bistable element and an organic EL element. As a result the bistable element is in the ON state during the reset period, a driving current flows to the organic EL element via the bistable element, and the organic EL element emits light. A voltage Vlow-Vset, which is higher than the voltage Voff, is applied in the forward direction during the set period immediately thereafter. Thus, the bistable element continues in the ON state, the driving current continues to flow to the organic EL element via the bistable element, and the organic EL element continues to emit light. On the other hand, in a pixel portion which is not driven to emit light, a voltage Vlow-Vreset, which is higher than the voltage Von, is applied in the forward direction-during the reset period to the composite element having a bistable element and an organic EL element. Thus, the bistable element of the pixel portion which is not driven to emit light is in the ON state during the reset period, the driving current flows to the organic EL element via the bistable element, and the organic EL element emits light. The voltage Vhigh-Vset, which is lower than the voltage Voff, is then applied over the set period immediately thereafter. As a result, the bistable element enters the OFF state, a current sufficient to cause light emission does not flow to the organic EL element, and the organic EL element does not emit light. During the reset period, the organic EL element of a pixel portion not to be driven does emit light, but only momentarily, and the light emitted can be ignored.

When the specification period for the one scan line in the current one field period ends, the organic EL elements in composite elements on the one scan line continue in the same state until the specification period in the next one field period.

Using the display device shown in FIG. 6, it is also possible to perform control so as to forcibly turn on the bistable element in each of the pixel portions on the one scan line during the reset period, leave the turned-on of the bistable elements of pixel portions which are driven to emit light during the set period, and turn off the bistable elements in the remaining pixel portions which are not driven to emit light.

The bistable elements of the pixel portions in the matrix display panels of each of the above-described embodiments may be any element capable of selectively maintaining states corresponding to two values. Moreover, the light emitting elements of the pixel portions are not limited to organic EL elements, but may be LEDs or other light emitting elements.

The layered structure of the composite element shown in FIG. 2 has a structure in which the anode is on the substrate side, but a layered structure may be formed in which the cathode is on the substrate side.

Further, a matrix display panel in which the invention is employed may be a monochrome display, or may be a multicolor display. By using the subfield method or the area gradation method, expression of numerous gray scales is possible.

As described above, according to the present invention, a matrix display panel having in each pixel portion a series circuit of a bistable element and a light emitting element can be employed to realize a matrix display-type display device with an active driving method, of simple construction and at low cost.

This application is based on a Japanese Application No. 2003-66267 which is hereby incorporated by reference.

What is claimed is:

1. A display device comprising:

a matrix display panel including a plurality of driving lines, a plurality of scan lines intersecting with said plurality of driving lines, and a plurality of pixel portions which are arranged at the intersecting portions by said plurality of driving lines and said plurality of scan lines and which each include a series circuit of a bistable element and a light emitting element, wherein when a voltage exceeding a turn-on threshold voltage is applied to said series circuit, said bistable element is in an ON state to allow said light emitting element to electrically connect between a driving line and a scan line associated with said series circuit until a voltage lower than a turn-off threshold voltage is applied to said series circuit, and when a voltage lower than the turn-off threshold voltage is applied to said series circuit, said bistable element is in an OFF state to allow said light emitting element to electrically disconnect between said driving line and said scan line associated with said series circuit until a voltage exceeding the turn-on threshold voltage is applied to said series circuit;

a controller which specifies in order one scan line of said plurality of scan lines in accordance with scan timing of an input image signal, and specifies a driving line corresponding to at least one pixel portion to be driven to emit light on said one scan line in accordance with the input image signal; and a driver which applies, every time said one scan line is specified, a first predetermined voltage which is lower than the turn-off threshold voltage, between said one scan line and the specified driving line, and thereafter applies a second predetermined voltage which is higher than the turn-on threshold voltage, between said one scan line and the specified driving line.

2. The display device according to claim 1, wherein every time said one scan line is specified, said driver applies a third predetermined voltage which is lower than the turn-off threshold voltage, between said one scan line and the remaining driving lines other than the specified driving line, and thereafter applies a fourth predetermined voltage which is lower than the turn-on threshold voltage, between said one scan line and the remaining driving lines.

3. The display device according to claim 2, wherein said driver includes:

a scan line circuit which applies, every time said one scan line is specified, a reset voltage to said one scan line, and immediately thereafter applies a set voltage to said one scan line; and every time said one scan line is specified, a driving line circuit which applies, during a period of the application of the reset voltage, a fifth predetermined voltage to the specified driving line and a sixth predetermined voltage which is different from said fifth predetermined voltage to the remaining driving lines, and which applies, during a period of the application of the set voltage, the sixth predetermined voltage to the specified driving line and the fifth predetermined voltage to the remaining driving lines, and the difference between the fifth predetermined voltage and the reset voltage is equal to the first predetermined voltage, the difference between the sixth predetermined voltage and the set voltage is equal to the second predetermined voltage, the difference between the sixth predetermined voltage and the reset voltage is equal to the third predetermined voltage, and the difference, between the fifth predetermined voltage and the set voltage is equal to the fourth predetermined voltage.

4. The display device according to claim 1, wherein each of said light emitting elements is an organic electroluminescence elements formed integrally with the bistable element.

5. A display device comprising:

a matrix display panel including a plurality of driving lines, a plurality of scan lines intersecting with said plurality of driving lines, and a plurality of pixel portions which are arranged at the intersecting portions by said plurality of driving lines and said plurality of scan lines and which each include a series circuit of a bistable element and a light emitting element, wherein when a voltage exceeding a turn-on threshold voltage is applied to said series circuit, said bistable element is in an ON state to allow said light emitting element to electrically connect between a driving line and a scan line associated with said series circuit until a voltage lower than a turn-off threshold voltage is applied to said series circuit, and when a voltage lower than the turn-off threshold voltage is applied to said series circuit, said bistable element is in an OFF state to allow said light emitting element to electrically disconnect between said driving line and said scan line associated with said series circuit until a voltage exceeding the turn-on threshold voltage is applied to said series circuit;

a controller which specifies in order one scan line of said plurality of scan lines in accordance with scan timing of an input image signal, and specifies a driving line corresponding to at least one pixel portion to be driven to emit light on said one scan line in accordance with the input image signal; and a driver which applies, every time said one scan line is specified, a first predetermined voltage which is higher than the turn-on threshold voltage, between said one scan line and the specified driving line, and thereafter applies a second predetermined voltage which is lower than the turn-off threshold voltage, between said one scan line and the specified driving line.

6. The display device according to claim 5, wherein every time said one scan line is specified, said driver applies a third predetermined voltage which is higher than the turn-on threshold voltage, between said one scan line and the remaining driving lines other than the specified driving line, and thereafter applies a fourth predetermined voltage which is lower than the turn-off threshold voltage, between said one scan line and the remaining driving lines.

7. The display device according to claim 6, wherein said driver includes:

a scan line circuit which applies, every time said one scan line is specified, a reset voltage to said one scan line, and immediately thereafter applies a set voltage to said one scan line; and every time said one scan line is specified, a driving line circuit which applies, during a period of the application of the reset voltage, a fifth predetermined voltage to the specified driving line and a sixth predetermined voltage which is different from said fifth predetermined voltage to the remaining driving lines, and which applies, during a period of the application of the set voltage, the sixth predetermined voltage to the specified driving line and the fifth predetermined voltage to the remaining driving lines, and the difference between the fifth predetermined voltage and the reset voltage is equal to the first predetermined voltage, the difference between the sixth predetermined voltage and the set voltage is equal to the second predetermined voltage, the difference between the sixth predetermined voltage and the reset voltage is equal to the third predetermined voltage, and the difference between the fifth predetermined voltage and the set voltage is equal to the fourth predetermined voltage.

8. The display device according to claim 5, wherein each of said light emitting elements is an organic electroluminescence elements formed integrally with the bistable element.

9. A method of driving a matrix display panel including a plurality of driving lines, a plurality of scan lines intersecting with said plurality of driving lines, and a plurality of pixel portions which are arranged at the intersecting portions by said plurality of driving lines and said plurality of scan lines and which each include a series circuit of a bistable element and a light emitting element, wherein when a voltage exceeding a turn-on threshold voltage is applied to said series circuit, said bistable element is in an ON state to allow said light emitting element to electrically connect between a driving line and a scan line associated with said series circuit until a voltage lower than a turn-off threshold voltage is applied to said series circuit, and when a voltage lower than the turn-off threshold voltage is applied to said series circuit, said bistable element is in an OFF state to allow said light emitting element to electrically disconnect between said driving line and said scan line associated with said series circuit until a voltage exceeding the turn-on threshold voltage is applied to said series circuit; said method comprising the steps of:

specifying in order one scan line of said plurality of scan lines in accordance with scan timing of an input image signal, and specifying a driving line corresponding to at least one pixel portion to be driven to emit light on said one scan line in accordance with the input image signal; and applying, every time said one scan line is specified, a first predetermined voltage which is lower than the turn-off threshold voltage, between said one scan line and the specified driving line, and thereafter applying a second predetermined voltage which is higher than the turn-on threshold voltage, between said one scan line and the specified driving line.

10. A method of driving a matrix display panel including a plurality of driving lines, a plurality of scan lines intersecting with said plurality of driving lines, and a plurality of pixel portions which are arranged at the intersecting portions by said plurality of driving lines and said plurality of scan lines and which each include a series circuit of a bistable element and a light emitting element, wherein when a voltage exceeding a turn-on threshold voltage is applied to said series circuit, said bistable element is in an ON state to allow said light emitting element to electrically connect between a driving line and a scan line associated with said series circuit until a voltage lower than a turn-off threshold voltage is applied to said series circuit, and when a voltage lower than the turn-off threshold voltage is applied to said series circuit, said bistable element is in an OFF state to allow said light emitting element to electrically disconnect between said driving line and said scan line associated with said series circuit until a voltage exceeding the turn-on threshold voltage is applied to said series circuit; said method comprising the steps of:

specifying in order one scan line of said plurality of scan lines in accordance with scan timing of an input image signal, and specifying a driving line corresponding to at least one pixel portion to be driven to emit light on said one scan line in accordance with the input image signal; and applying, every time said one scan line is specified, a first predetermined voltage which is higher than the turn-on threshold voltage, between said one scan line and the specified driving line, and thereafter applying a second predetermined voltage which is lower than the turn-off threshold voltage, between said one scan line and the specified driving line.

* * * * *